United States Patent [19]

Leding

[11] Patent Number: 4,533,019

[45] Date of Patent: Aug. 6, 1985

[54] MAXI-BALL LUBRICATOR AND DISPENSER FOR MUZZLE LOADING FIREARMS

[75] Inventor: Kenneth J. Leding, Ozark, Ark.

[73] Assignee: Leding Loader, Inc., Ozark, Ark.

[21] Appl. No.: 604,527

[22] Filed: Apr. 27, 1984

[51] Int. Cl.[3] ..... F42B 31/02; F41C 27/00

[52] U.S. Cl. ..... 184/14; 42/90; 86/19

[58] Field of Search ..... 42/90; 86/19, 33; 184/14

[56] References Cited

U.S. PATENT DOCUMENTS

| | | | |
|---|---|---|---|
| 2,016,676 | 10/1935 | Hess | 86/19 |
| 2,403,032 | 7/1946 | Stevens | 86/19 |
| 4,108,044 | 8/1978 | Brown | 86/19 |
| 4,254,572 | 3/1981 | Nelson | 42/90 |
| 4,353,282 | 10/1982 | Holt | 42/90 X |
| 4,384,424 | 5/1983 | Fowler | 42/90 |
| 4,414,770 | 11/1983 | Brinton | 42/90 |
| 4,434,571 | 3/1984 | Eisenhuth | 42/90 |
| 4,442,620 | 4/1984 | Drake et al. | 42/90 |

*Primary Examiner*—David H. Brown
*Attorney, Agent, or Firm*—Stephen D. Carver

[57] ABSTRACT

A portable maxi ball lubricator and dispenser for muzzle loading firearms which temporarily stores a plurality of maxi-ball projectiles for subsequent loading. An elongated preferably plastic frame is of generally rectangular dimensions, and it includes a plurality of spaced-apart bullet chambers defined at regular intervals. An internal grease reservoir defined in one end of the frame stores grease, and the grease is distributed to the bullet chambers by an elongated passageway system. The passageway system includes a tunnel interconnecting the grease reservoir with a first one of the chambers, a plurality of tunnels interconnecting adjacent chambers, and a relief vent which is in fluid flow communication between the last chamber and atmosphere. When a suitable deposit of grease has been accumulated within the reservoir, a thumb screw associated with the frame may be turned manually into the reservoir to forceably pump grease through the passageway system and into each of the bullet chambers. The bullets, which include one or more intermediate grooves, are confined frictionally within the chambers, and grease will be forced through adjacent tunnels and around the bullet grooves to eventually thoroughly lubricate each and every bullet. When grease has been adequately distributed, a small stream of grease exiting the relief vent will be evident to the shooter, and he will know that each of the bullets stored within the device is ready for loading.

5 Claims, 8 Drawing Figures

MAXI-BALL LUBRICATOR AND DISPENSER FOR MUZZLE LOADING FIREARMS

BACKGROUND OF THE INVENTION

The present invention relates generally to devices for loading muzzle loading firearms. More particularly, the present invention comprises a portable, hand-held lubricator and dispenser adapted for use in inserting bullets such as "maxi-balls" or similar bullets into the barrel of muzzle loading rifles or the like.

As will be appreciated by those skilled in the firearms arts, "muzzle loading" firearms have existed for several centuries. While a great variety of technologically sophisticated modern firearms currently exist, a resurgence in muzzle loading firearm interest has lately gained a great deal of momentum amongst shooters. Many shooters feel that modern semiautomatic weapons remove the challenge or thrill to hunting. Other shooters and hunters greatly enjoy the lengthened hunting seasons associated with the use of muzzle loading weapons. For example, in the State of Arkansas, muzzle loaders enjoy a fall deer hunting season which is several weeks longer than that afforded the users of modern semiautomatic sporting arms.

Currently it is probable that the most popular ignition system employed with muzzle loading firearms involves the use of "percussion caps" detonated by the hammer which ignites the powder charge which has been previously loaded into the barrel. In a percussion muzzle loader explosive caps are inserted into a rear nipple which communicates interiorly of the barrel adjacent the explosive charge to produce ignition when the impacting hammer contacts same. Relatively older "Flintlock" weapons are also popular. In these devices a "hammer" essentially strikes a spark upon impact to ignite the gunpowder charge. Usually the firearm will include a ram-rod which is stored or mounted relative to the firearm in spaced-apart, parallel relation relative to the barrel. The ram rod is utilized to drive bullets (i.e. "muzzle loads") into the muzzle downwardly through the barrel into the proximity of the charge to be ignited. A wide variety of bullets are available for such firearms in such popular calibers as .45, .50, .54 and .58.

Historically a generally spherical lead ball which may have been cast by the shooter was merely rammed downwardly into the muzzle after a charge of black powder was previously introduced. Most muzzle loader hunters prefer to use what is now referred to as the "maxi-ball" for a wide variety of reasons. First, such a projectile is inherently more accurate. Moreover, because of the configuration of such bullets, they have more mass and hence are more effective in taking game. These loads also include one or more spaced-apart grooves in which a suitable lubricant such as grease may be packed prior to loading. As will be appreciated by those skilled in the muzzle loading art, prior to loading such "maxi-balls" most shooters much manually grease the projectile prior to insertion within the muzzle. During outdoor hunting conditions, dirt-free greasing and loading is extremely difficult, if not impossible.

Hence I have designed and invented a device to aid the muzzle loader in cleanly loading his firearm with a maxi ball, while facilitating a uniform distribution of lubricating grease.

SUMMARY OF THE INVENTION

The present invention comprises a portable maxi-ball lubricator and dispenser which temporarily stores a plurality of maxi-ball projectiles for subsequent loading and shooting. The elongated plastic frame is of generally rectangular dimensions, and it includes a plurality of spaced-apart bullet chambers defined at regular intervals upon its length. A grease reservoir defined in one end of the frame stores grease, and the grease is distributed to the bullet chambers by an elongated passageway system. The passageway system includes a tunnel interconnecting the grease reservoir with a first one of the chambers, a plurality of tunnels interconnecting adjacent chambers, and it preferably includes a final relief vent which is in fluid flow communication between the last chamber and atmosphere.

The reservoir provides a storage space for the manual insertion of a suitable bullet lubricant such as the muzzle loading grease conventionally sold by Thompson Center Firearms. When a suitable deposit of grease has been accumulated, a thumb screw may be turned manually into the reservoir to forceably pump grease through the passageway system and into each of the bullet chambers. The bullets, which include one or more intermediate grooves, are confined frictionally within the chambers, and grease will be forced through adjacent tunnels and around the bullet grooves to eventually thoroughly lubricate each and every bullet. When grease has been adequately distributed, a small stream of grease exiting the relief vent will be evident to the shooter, and he will know that each of the bullets stored within the device is ready for loading.

In operation the maxi-ball lubricator and dispenser may be loaded with bullets and grease prior to entering the field for a hunt. Once in the field the weapon may be loaded by initiating bullet withdrawal by the thumb of one hand. Subsequently the bullet is forced by the conventional ram-rod out of the chamber into the mouth of the muzzle loading firearm. In this fashion the shooter will be certain of an adequate grease pack and the introduction of dirt, debris or other unwanted residue interiorly of the firearm will be minimized if not prevented altogether.

Thus a broad object of the present invention is to provide a system for quickly loading muzzle loading firearms.

A still further object of the present invention is to provide a system of the character described which will store and grease a plurality of maxi-balls for muzzle loading firearms.

A still further object of the present invention is to provide a system for temporarily storing maxi-balls which will maintain them in a state of greased readiness.

Yet another object of the present invention is to provide a dispenser of the type described which generates a warning signal for the user to alert him to the fact that bullets inserted and carried thereby are adequately greased.

A related object of the present invention is to provide a bullet dispenser of the character described which will forceably lubricate captured bullets merely by the manual twisting of an integral pump.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
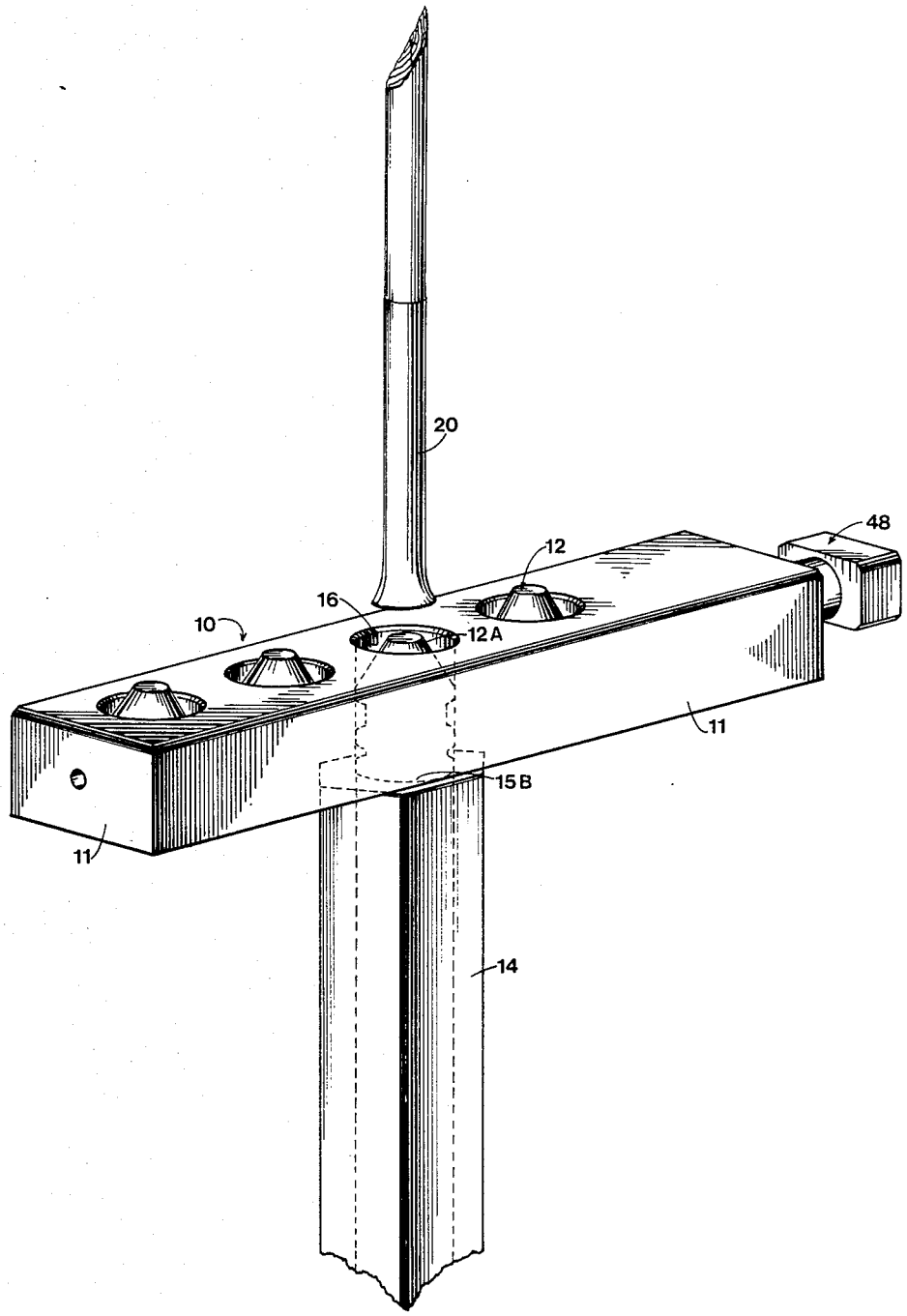
FIG. 1 is a fragmentary, isometric view illustrating an ammunition dispenser constructed in accordance with preferred the teachings of this invention.
Figure 2:
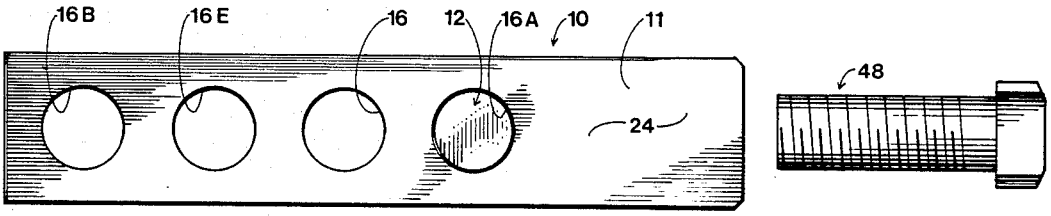
FIG. 2 is a bottom plan view of the dispenser of FIG. 1, with the reservoir thumb screw removed and with no bullets loaded thereinto.
Figure 3:
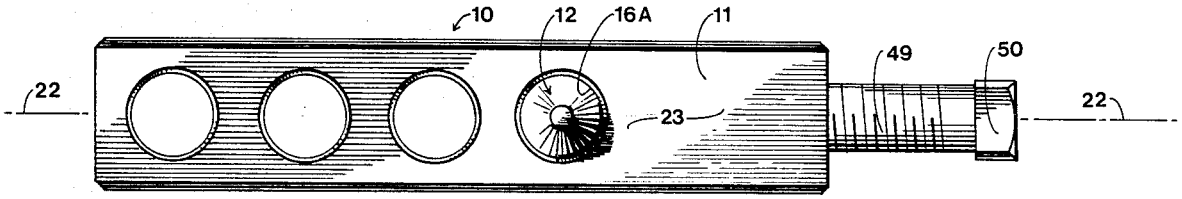
FIG. 3 is a top plan view similar to FIG. 2, but illustrating the thumb screw inserted partially into the reservoir.

With initial reference now to FIG. 1 of the drawings, a bullet loader or dispenser device constructed in accordance with teachings of the present invention has been generally designated by the reference numeral 10. Loader 10 is adapted to temporarily store a plurality of bullets, generally designated by the reference numeral 12, and to facilitate their subsequent insertion into the muzzle 14 of a conventional muzzle loading firearm barrel. Bullets 12 are temporarily stored within suitable chambers defined in the frame 11 of the dispenser 10. Chamber 16, for example, includes a partially ejected bullet 12A which is about to be rammed into the muzzle of barrel 14. Preferably a bullet will first be partially pushed downwardly within a chamber towards the muzzle 14 by the thumb of the operator, and afterwards it will be forced into barrel 14 via muzzle 15B with a conventional ram rod 20.

Figure 4:
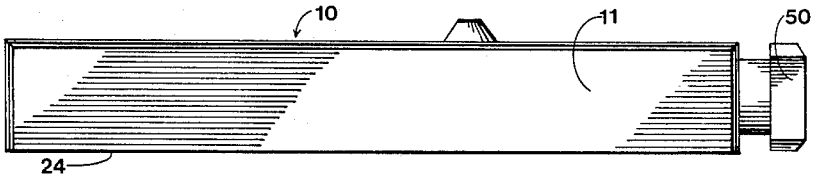
FIG. 4 is a side elevational view of the dispenser.

With reference now to FIGS. 2 through 8, dispenser frame 11 is of generally elongated, rectangular dimensions. As best viewed in FIGS. 6 through 8, it is also of generally rectangular vertical section. Frame 11, which is preferably molded or machined from plastic, includes an elongated axis 22 defining its center. A plurality of bullet chambers such as chambers 16, 16A and 16B are preferably defined in frame 11, and interconnect frame top 23 with frame bottom 24 (FIG. 4). In other words, a bullet such as bullet 12 may be manually inserted into a chamber 16 from top 23, and if thereafter depressed it will drop from the bottom of frame 11 out of the loader.

Figure 5:
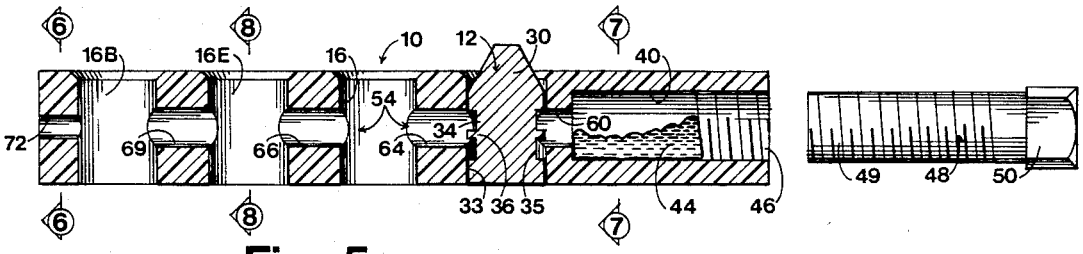
FIG. 5 is a longitudinal sectional view thereof.
Figure 6:
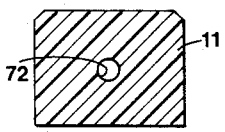
FIG. 6 is a sectional view taken generally along line 6—6 of FIG. 5.
Figure 7:
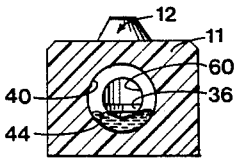
FIG. 7 is a sectional view taken generally along line 7—7 of FIG. 5; and, FIG. 8 is a sectional view taken generally along line 8—8 of FIG. 5.
Figure 8:
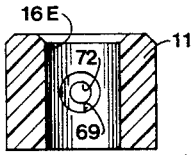

With reference now to FIG. 5, a typical "maxi-ball" 12 which is adapted to be employed in conjunction with the invention includes a generally frusto-conical forward end 30 and an integral lower spaced-apart cylindrical bottom 33. A pair of grooves 34, 35 are defined in the body of bullet 12 between spacer 36. Prior to use such bullets must be adequately greased, and the grease is disposed within grease grooves 34 and 35. A hollow grease reservoir 40 is defined within the frame 11 for storing a quantity of grease 44. Grease may be originally inputted into reservoir 40 through threaded aperture 46, which communicates with the reservoir and which is adapted to receive a similarly threaded thumb screw generally designated by the reference numeral 48. Thumb screw 48 includes an elongated threaded shank 49 adapted to be screwed to threaded passageway 46, and a head 50 which may be manually twisted by the sportsman to pressurize the grease charge within reservoir 44.

The grease distribution passageway, generally designated by the reference numeral 54, is aligned axially with axis 22 of frame 11. The grease passageway includes a first tunnel 60 which admits grease into chamber 16A. Grease will thence be distributed around bullet grooves 34 and 35, and thereafter grease will pass through a second tunnel 64 into bullet chamber 16 and from thence through tunnel 66 into chamber 16E. Thereafter pressurized grease will be transmitted through tunnel 69 into chamber 16B where it will similarly lubricate the bullet disposed therewithin. Each time pressurized grease flows through a tunnel into an adjacent chamber it will flow around and through the grooves 34 and 35 of the bullet disposed in the particular chamber to uniformly lubricate the bullet.

After lubrication of all the bullets disposed within the frame 11 is accomplished, a small stream of grease will escape frame the passageway relief vent 72 whereupon the sportsman will know that his maxi-balls have been adequately greased. Preferably the diameter of the vent passageway 72 is between one fourth and one half of the diameter of the tunnels 60, 64, 66 or 69. Nominally the diameter of each of the tunnels is approximately $\frac{1}{4}$ inch and the diameter of the relief vent is approximately $\frac{1}{8}$ inch.

From the foregoing it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable maxi ball lubricator and dispenser for loading muzzle loading firearms, said dispenser comprising:

an elongated frame adapted to be hand-held by a shooter, said frame having a longitudinal axis;

a plurality of generally cylindrical bullet chambers defined in said frame adapted to at least temporarily store a bullet for subsequent loading into a muzzle loading firearm, each of said chambers being spaced-apart at regular intervals along the length of said frame and substantially centered thereupon in perpendicular relationship with respect to said longitudinal axis;

a grease reservoir defined in said frame for storing lubricating grease; and, passageway means for delivering grease from said reservoir to said chambers to substantially uniformly lubricate said bullets disposed therewithin, said passageway means including a first tunnel interconnecting a first one of said chambers to said grease reservoir, a plurality of subsequent tunnels interconnecting adjacent subsequent chambers, and a terminal relief vent establishing fluid flow communication between the last one of said chambers and external atmosphere.

2. The maxi ball lubricator and dispenser as defined in claim 1 wherein said frame is comprised of resilient plastic material, said frame has a generally rectangular vertical cross section, said longitudinal frame axis is centered with respect to the cross section of said frame, and said reservoir, said relief vent and said passageway tunnels are axially aligned with said longitudinal frame axis.

3. The maxi ball lubricator and dispenser as defined in claim number 2 including manually actuable grease pumping means associated with said grease reservoir means for forcing grease through said passageway means and into each of said chambers, said pumping means comprising a thumb screw threadably removably coupled to an inlet orifice defined in said reservoir in substantial axial alignment with said longitudinal frame axis.

4. A portable maxi ball lubricator and dispenser device for loading muzzle loading firearms, said device comprising:

an elongated, resilient plastic frame adapted to be hand-held by a shooter, said frame having a longitudinal axis and a generally rectangular vertical cross section, said longitudinal frame axis being substantially centered with respect to the cross section of said frame;

a plurality of generally cylindrical bullet chambers defined in said frame adapted to at least temporarily store a bullet for subsequent loading into a muzzle loading firearm, each of said chambers being spaced-apart at regular intervals along the length of said frame and substantially centered thereupon in perpendicular relationship with respect to said longitudinal frame axis;

a grease reservoir defined in said frame for storing lubricating grease;

passageway means for delivering grease from said reservoir to said chambers to substantially uniformly lubricate said bullets disposed therewithin, said passageway means including a first tunnel interconnecting a first one of said chambers to said grease reservoir, and a plurality of subsequent tunnels interconnecting adjacent subsequent chambers;

manually actuable thumb screw grease pumping means associated with said grease reservoir means for forcing grease through said passageway means and interiorly of each of said chambers, said pumping means threadably removably coupled to an inlet orifice defined in said reservoir in substantial axial alignment with said longitudinal axis; and, a terminal relief vent establishing fluid flow communication between the last one of said chambers and external atmosphere, said vent responsive to grease pressure generated by said pumping means to ultimately warn said shooter that each of said chambers and the bullets disposed within said chambers are adequately lubricated.

5. The device as defined in claim 4 wherein said reservoir, said relief vent and said passageway tunnels are substantially axially aligned with respect to said frame longitudinal axis.

* * * * *